US008342267B1

(12) United States Patent
Hinshaw et al.

(10) Patent No.: US 8,342,267 B1
(45) Date of Patent: Jan. 1, 2013

(54) MINING MACHINE WITH IMPROVED RIB REACH CAPABILITY AND METHOD OF USE THEREOF

(75) Inventors: Gregory E. Hinshaw, Proctorville, OH (US); Henry E. Wilson, Ironton, OH (US); Robert S. Anderson, Culloden, WV (US)

(73) Assignee: J. H. Fletcher & Co., Huntington, WV (US)

( * ) Notice: Subject to any disclaimer, the term of this patent is extended or adjusted under 35 U.S.C. 154(b) by 316 days.

(21) Appl. No.: 12/559,933

(22) Filed: Sep. 15, 2009

Related U.S. Application Data

(60) Provisional application No. 61/097,096, filed on Sep. 15, 2008.

(51) Int. Cl.

| | |
|---|---|
| ***E21B 41/00*** | (2006.01) |
| ***E21C 37/00*** | (2006.01) |
| ***E21C 41/00*** | (2006.01) |
| ***E21C 47/00*** | (2006.01) |

(52) U.S. Cl. ..... 175/86; 175/94; 175/219

(58) Field of Classification Search ..... 175/62, 175/86, 94, 219; 299/11

See application file for complete search history.

(56) References Cited

U.S. PATENT DOCUMENTS

| | | | | |
|---|---|---|---|---|
| 2,750,155 | A * | 6/1956 | Nixon | 182/2.7 |
| 3,141,511 | A * | 7/1964 | O'Leary | 173/195 |
| 3,768,574 | A | 10/1973 | Long | |
| 3,951,215 | A | 4/1976 | Galis | |
| 4,094,361 | A * | 6/1978 | Yago | 169/48 |
| 4,284,368 | A | 8/1981 | Albright | |
| 4,290,490 | A | 9/1981 | Barthe et al. | |
| 4,398,850 | A | 8/1983 | Talvensaari | |
| 4,420,277 | A | 12/1983 | Hibbard et al. | |
| 4,744,699 | A | 5/1988 | Price et al. | |
| 4,953,914 | A | 9/1990 | LeBegue | |
| 5,951,208 | A * | 9/1999 | Wilson et al. | 405/259.6 |
| 7,032,686 | B2 | 4/2006 | Barthomeuf et al. | |

* cited by examiner

*Primary Examiner* — Cathleen Hutchins
(74) *Attorney, Agent, or Firm* — King & Schickli, PLLC

(57) ABSTRACT

An apparatus is for use by an operator in forming boreholes in a mine passage including a rib and a roof. The apparatus includes a boom having a proximal end mounted to a base, such as a vehicle. A drill supported by the boom near a distal end thereof is adapted for drilling into the rib of the mine passage. An operator's station carried by the boom adjacent the drill includes a platform for supporting the operator arranged at least partially between a generally vertical plane aligned with the second lateral side and the rib. Accordingly, the operator can access the rib when positioned on the operator's station without interference from the boom.

31 Claims, 9 Drawing Sheets

MINING MACHINE WITH IMPROVED RIB REACH CAPABILITY AND METHOD OF USE THEREOF

This application claims the benefit of U.S. Provisional Patent Application Ser. No. 61/097,096, filed Sep. 15, 2008, the disclosure of which is incorporated herein by reference.

TECHNICAL FIELD

The present invention relates to the mining arts and, more particularly, to a mining machine adapted for installing support in a rib of a mine passage.

BACKGROUND OF THE INVENTION

During underground mining, it is a requirement for purposes of safety as well as federal law to install support to the roof of a passage at various intervals. This is often done using a mining machine known in the vernacular as a "roof" bolter. Typically, such a roof bolter is capable of both forming (drilling) boreholes and then installing roof anchors or "bolts" in the boreholes.

Bolters sometimes include an elongated boom for raising and lowering an attached bolting module, which incorporates a drill for forming the borehole for receiving the bolt or anchor. Sometimes, these booms are unmanned. However, in some cases they include an onboard station designed to support the operator of the bolting module.

In such cases where an operator station is provided, it has in the past been the case that the elongated boom is positioned between the operator and the corresponding rib of the mine passage to protect the operator from lateral hazards, such as rib rolls. From this position the boom serves as an obstacle that prevents the operator from easily and efficiently accessing the rib, such as to install the resin or bolt in the borehole once formed. As a result, it has in the past been proposed to use mechanical systems for installing the resin and bolts in the rib, but this increases the complexity and cost of the resulting bolting module.

Accordingly, a need is identified for a boom arrangement carrying an operator station adapted for installing support in the rib of a mine passage. The boom would allow an operator positioned at the station easy access to the rib for drilling a borehole, inserting resin in the borehole, and installing an anchor, such as a bolt. Despite the enhanced access, the boom would also incorporate features that check the operator's activities and help prevent use of the boom in an unintended manner.

SUMMARY OF THE INVENTION

One aspect of the present disclosure pertains to an apparatus for use by an operator in forming one or more borehole in an underground mine passage including a rib and a roof. The apparatus comprises a base and an elongated boom having a longitudinal axis. The boom includes a proximal end mounted to the base, a distal end opposite the proximal end, a first lateral side adjacent the rib, and a second lateral side opposite the first lateral side. A drill is supported by the boom near the distal end thereof, and is adapted for drilling into the rib of the mine passage. An operator's station carried by the boom adjacent the drill is adapted to allow the operator to access the rib when positioned on the operator's station without interference from the boom.

In one embodiment, the operator's station is at least partially positioned between a first plane extending generally parallel to the rib and a second plane aligned with an adjacent face of the boom. The operator's station may include a platform for supporting the operator arranged at least partially between a generally vertical plane aligned with the second lateral side and the rib. Most preferably, the operator's station extends across a central longitudinal axis of the boom to the second lateral side of the boom.

The operator's station may further include a shield for at least partially shielding the operator from a face of the mine passage. In accordance with a further aspect of the disclosure, a disable switch is associated with the shield, such as along an upper portion thereof. The disable switch may be connected to a pivotally mounted lever that serves to cutoff power to a motive device for moving the boom.

The boom may comprise a plurality of telescoping sections and means for telescoping the sections. Means for raising or lowering the boom may also be provided. The apparatus may further include means for moving the drill relative to the boom, which in one embodiment may include a turret for mounting the drill to the distal end of the boom. Preferably, the arrangement is such that the drill is adapted to provide a generally horizontal drilling axis that intersects a plane generally parallel to a generally vertical face of the rib. Most preferably, the operator's station includes a platform for supporting the operator in a standing position, and an upper surface of the boom is lower than a top of the operator's shoulder when standing on the platform.

A vehicle may be associated with the boom. The vehicle may include a walkway having an exit end adjacent to the platform of the operator's station. The vehicle may further include a second boom having a second operator's station accessible from the walkway.

In accordance with another aspect of the disclosure, an apparatus for use by an operator in forming boreholes in a mine passage including a rib and a roof includes a base and an elongated boom carried by the base and including a longitudinal axis. A drill is supported by the boom near the distal end thereof. A motive device is provided for moving the boom relative to the base, and an operator's station is carried by the boom adjacent the drill. The operator's station includes a platform for supporting the operator in a manner that permits the operator to access the rib. The platform includes a shield for at least partially shielding the operator from the rib, as well as a disable switch for disabling the motive device upon the operator at the station leaning toward the rib. Preferably, the disable switch is connected to a lever pivotally mounted adjacent to an upper end of the shield, and the drill is adapted to provide a generally horizontal drilling axis.

Another aspect of the disclosure pertains to a method for forming boreholes in a mine passage including an adjacent rib and a roof. The method comprises: (1) providing a vehicle including a boom carrying a drill, said boom including a station adapted for receiving an operator, said station extending in a space at least partially between the rib and a plane aligned with an adjacent face of the boom; and (2) drilling a borehole in the rib using the drill. The method may further include the step of disabling the boom if the operator leans towards the rib.

DETAILED DESCRIPTION OF THE INVENTION

Figure 1A:
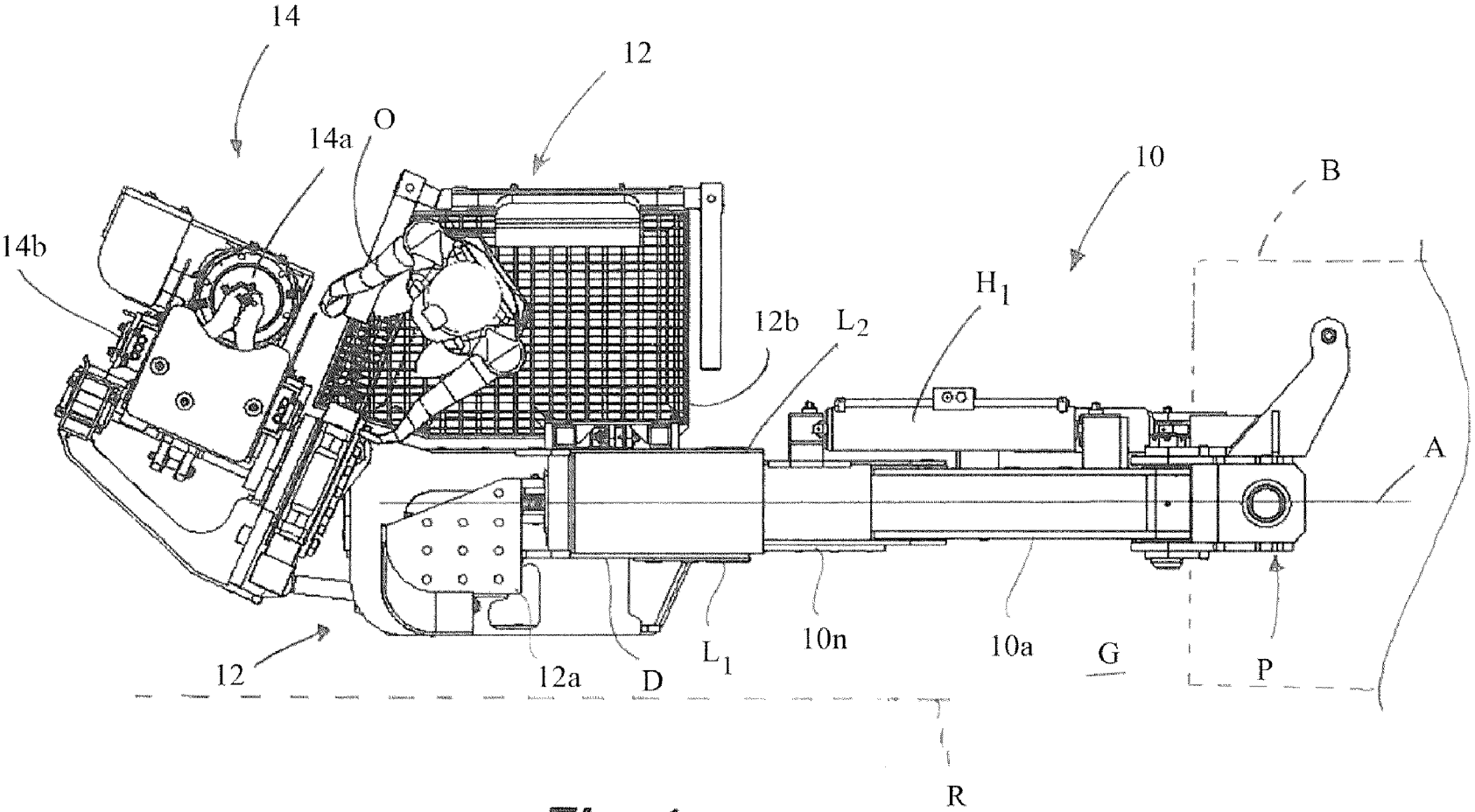
FIG. 1*a* is a top plan view of a boom specially adapted for installing support in the rib of a mine passage.
Figure 4A:
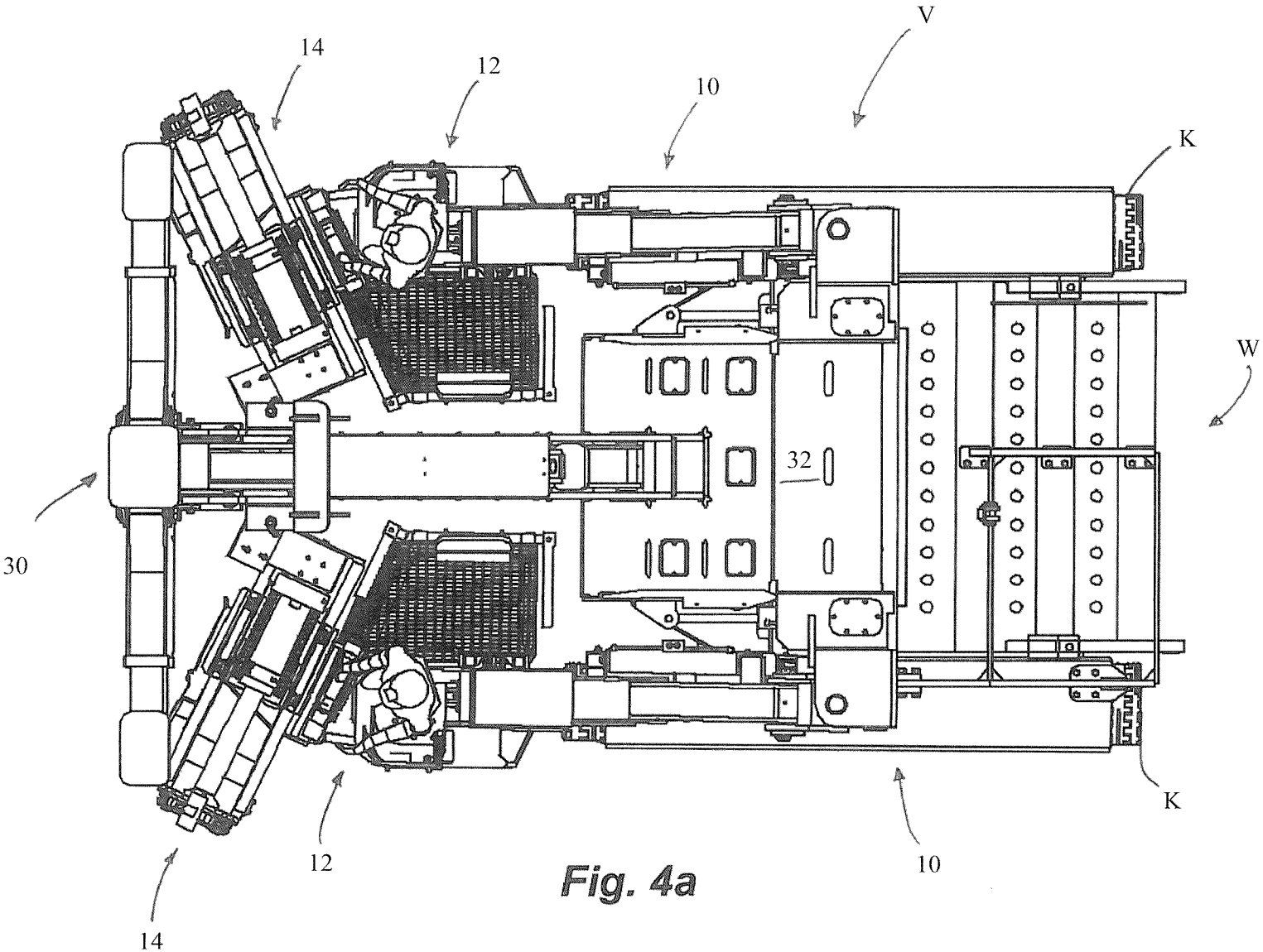
FIG. 4*a* is a top plan view of a vehicle incorporating dual booms.
Figure 4B:
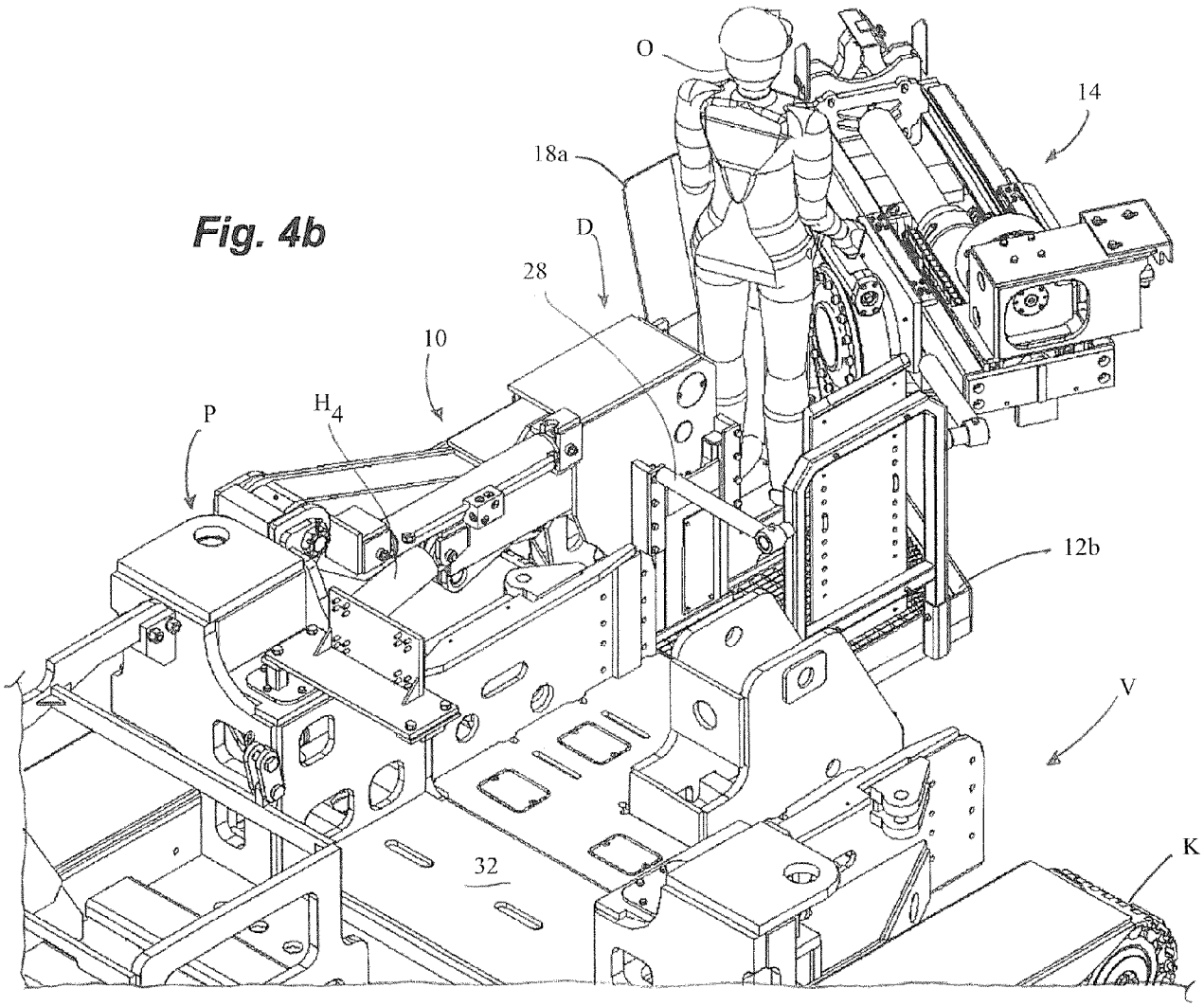
FIG. 4*b* is a partially cutaway rear view of the vehicle of FIG. 4*a*, showing a walkway leading to the operator's station of the boom.

Reference is now made to FIG. 1*a*, which is a top view illustrating one embodiment of a boom 10 for proposed use in or on a mining machine, such as one commonly referred to as a "roof" bolter adapted for moving about an underground mine passage (see, e.g., vehicle V of FIGS. 4*a* and 4*b* including crawler tracks K). The boom 10 comprises an elongated structure defining a longitudinal axis A, and includes a proximal end P for mounting to a base B of the mining machine, a distal end D generally opposite the proximal end, a first lateral side $L_1$ adjacent the rib, and an opposite lateral side $L_2$.

The boom 10 may have a fixed length or, as shown in FIG. 1*a*, may be comprised of a plurality of interconnected, telescoping segments or sections 10*a* . . . 10*n*. Means, such as an extensible cylinder $H_1$ or other type of actuator, is also typically provided for telescoping one or more of the sections, and a second such cylinder $H_2$ or actuator may be provided for raising and lowering the boom 10 relative to the base B and the ground G (i.e., the floor of a mine passage in which the machine is movably positioned).

Figure 1B:
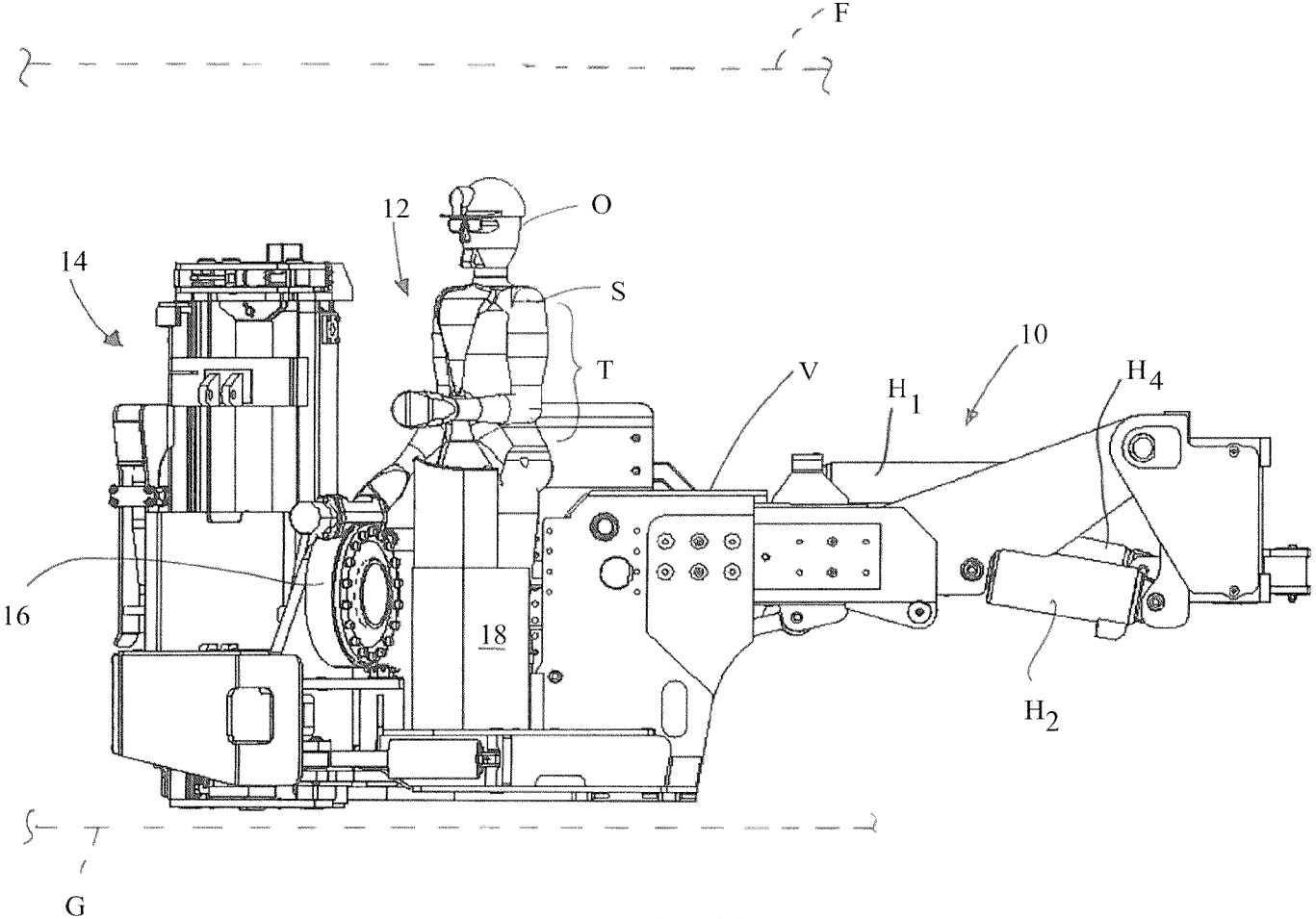
FIG. 1*b* is a side view of the boom of FIG. 1*a;*

With continued reference to FIG. 1*a*, as well as to FIG. 1*b*, it can be best understood that a station 12 for supporting the operator O is provided near the distal end D of the boom 10, as is a drill 14. The operator's station 12 includes at least one platform 12*a* providing a place on which the operator O may stand during a drilling or bolting event. This platform 12*a* is preferably mounted directly to the distal end D of the boom 10, and thus moves along with it in all possible directions.

Figure 2A:
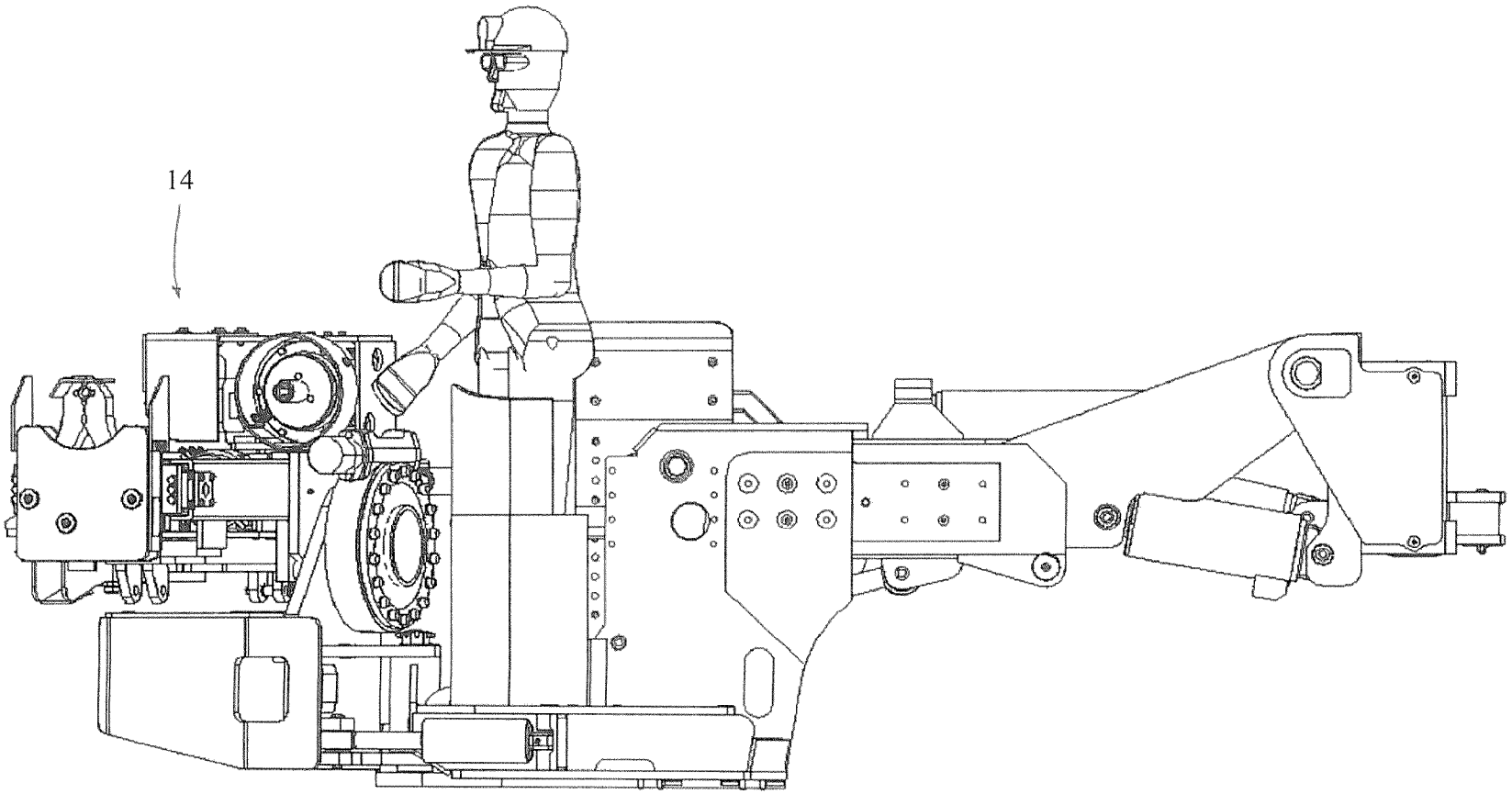
FIG. 2*a* is a side view of the boom of FIGS. 1*a* and 1*b*, showing the drill oriented toward the rib.
Figure 2B:
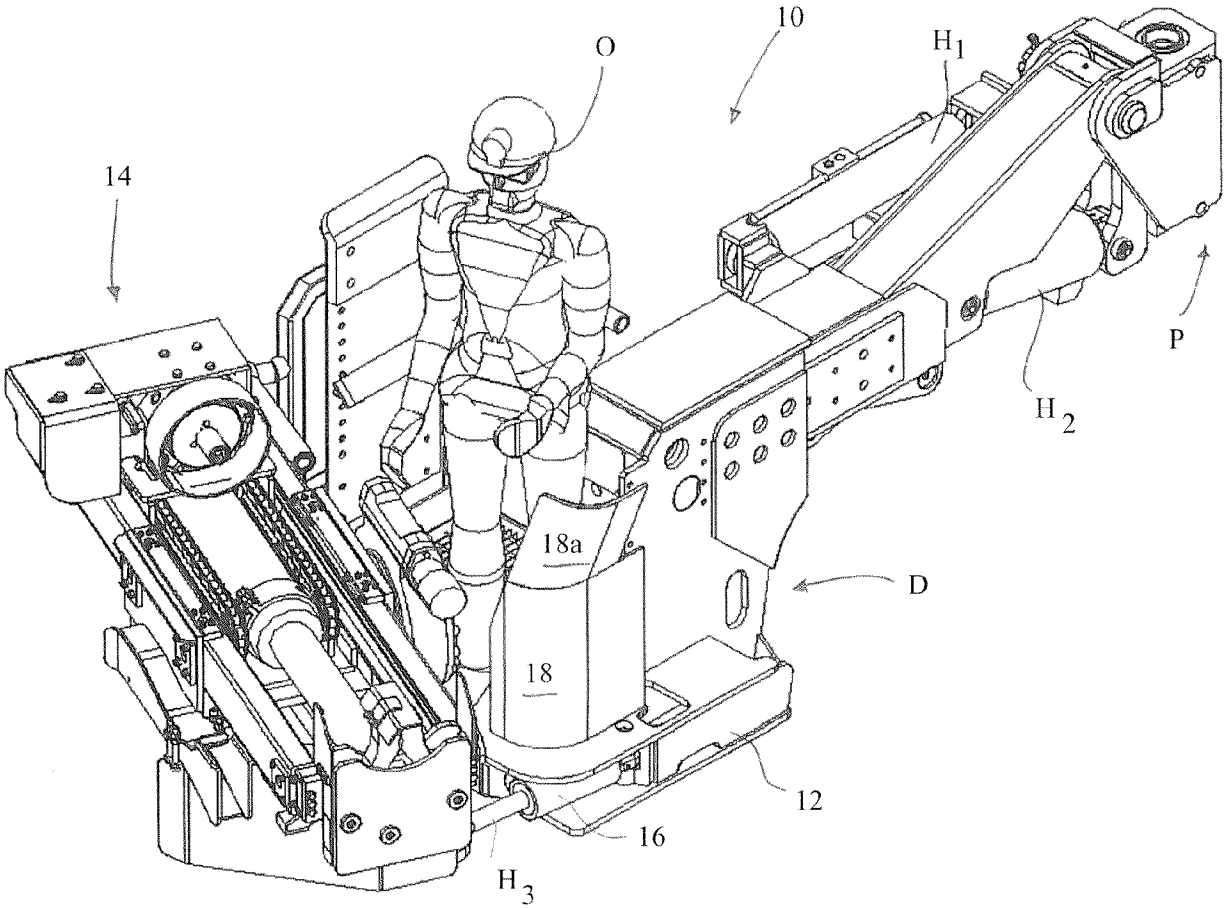
FIG. 2*b* is a front perspective view of the boom of FIG. 2*a;*
Figure 2C:
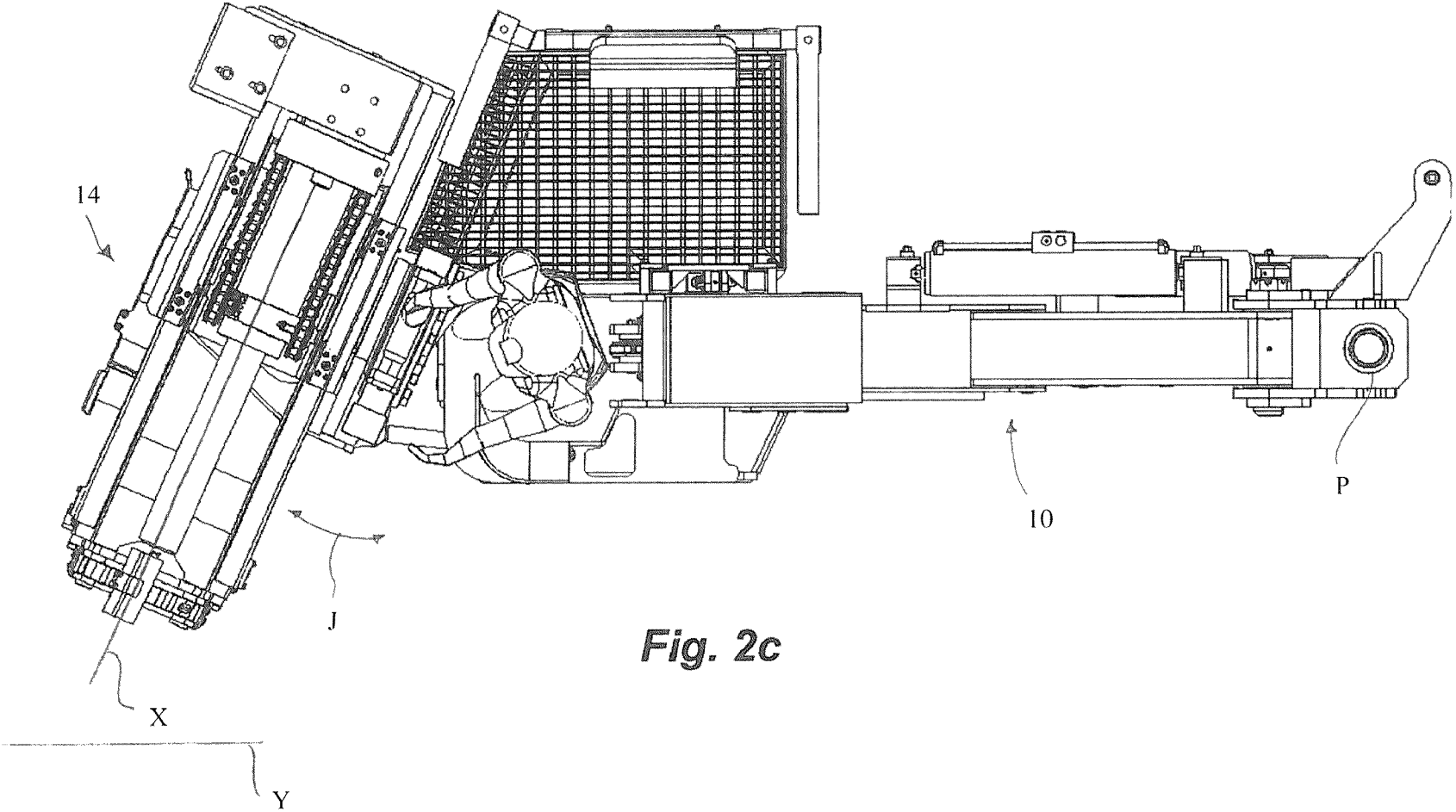
FIG. 2*c* is a top plan view of the boom of FIG. 2*c;*

The drill 14 (commonly referred to as a rig) is adapted for forming boreholes in a corresponding face of the mine passage, including at least the rib R. Consequently, this drill 14 is mounted for movement in multiple directions along with the boom 10 so as to facilitate the drilling of boreholes. This is preferably achieved by pivotally mounting the drill 14 to the distal end of the boom 12, such as by connecting it to a turret 16 having an axis of rotation that is generally orthogonal to a drilling axis X formed by the linear path of travel of a drill head 14*a* (preferably, a rotary one incorporating a hydraulic motor, not shown) along a guide frame 14*b*, both forming part of the drill 14 (see FIG. 1*a*). Thus, as shown in FIGS. 2*a*, 2*b*, and 2*c*, the drill 14 may rolled over and also may be "knuckled" inward such that this drilling axis X intersects a vertical plane Y aligned generally parallel to the rib R (compare FIGS. 1*b* and 2*b*).

Means may also be provided for moving the drill 14 relative to the operator's platform 12, such as a motive device in the form of cylinder $H_3$. This may be used to rotate or swing the drill 14 within a plane generally parallel to the ground G (see action arrow J in FIG. 2*c*). As should be appreciated, this swinging may alter the relative positioning of the drilling axis X and, thus, the direction(s) in which the borehole is formed or any bolt or anchor installed. The orientation of this axis X may also be altered based on the relative swinging of the boom 10 about the pivot point established by the mounting at the proximal end P to base B, which may be effected by a motive device such as cylinder $H_4$ (see FIG. 4*b*) or similar actuator.

Controls for manually or automatically controlling the drill 14 and the associated moving means may also be provided in a convenient place for being accessed by the operator O when positioned at or adjacent the operator's station 12. Most preferably, the platform 12*a* may also be raised or lowered relative to any controls associated with the operator's station 12.

In accordance with one aspect of the disclosure, the operator's station 12 associated with the boom 10 is arranged so as occupy a space at least partially between a generally vertical plane aligned with the lateral side $L_2$ and the vertical plane Y generally parallel to a vertical face of the adjacent rib R. In the particular embodiment illustrated, the station 12 is thus positioned so as to intersect with the longitudinal axis A of the boom 10, adjacent the distal end D of the boom 10 (see FIG. 1*a*). Preferably, an upper surface U of the boom 10 is also arranged to as to be lower that a top of the shoulder S of the operator O when standing at the station 12, and most preferably lies below the upper torso T of the operator O.

Consequently, it can be seen that the operator O when positioned at the station 12 is able to fully and freely access the rib R, such as for inserting resin cartridges or bolts into boreholes formed, for example, using the drill 14 (see, e.g., U.S. Pat. Nos. 5,951,208 and 7,428,936, the disclosures of which are incorporated herein by reference). This includes standing on the station 12 in line with a longitudinal axis A of the boom 10, and possibly in the space between the lateral side $L_1$ and the adjacent rib R at least partially occupied by platform 12*a*. Such enhanced access allows for a remarkable reduction in the time and expense associated with installing the resin and bolt, since the necessary operations can be at least partially performed in a manual fashion without requiring the operator O to leave the station 12. The improved reachability afforded thus not only eases the burdens on the operator, but also may eliminate the need for associated machinery for performing one or more of these functions characteristic of past approaches.

In the illustrated, preferred embodiment, at least the platform 12*a* of the operator's station 12 is arranged to be positioned between the distal end D of the boom 10 and the drill 14 (or in other words, is in tandem with the boom 10). However, it is possible to provide the drill 14 between the operator's station 12 and the distal end D of the boom 10 while retaining the benefits of the inventive approach. Also, the operator's station 12 may include an auxiliary platform 12*b* that extends adjacent the corresponding end of drill 14 on the lateral side $L_2$ of the boom 10, opposite the side $L_1$ facing the rib R (which platform 12*b* may be made accessible from a central walkway W through an associated vehicle V; see FIGS. 4*a* and 4*b*).

Figure 3A:
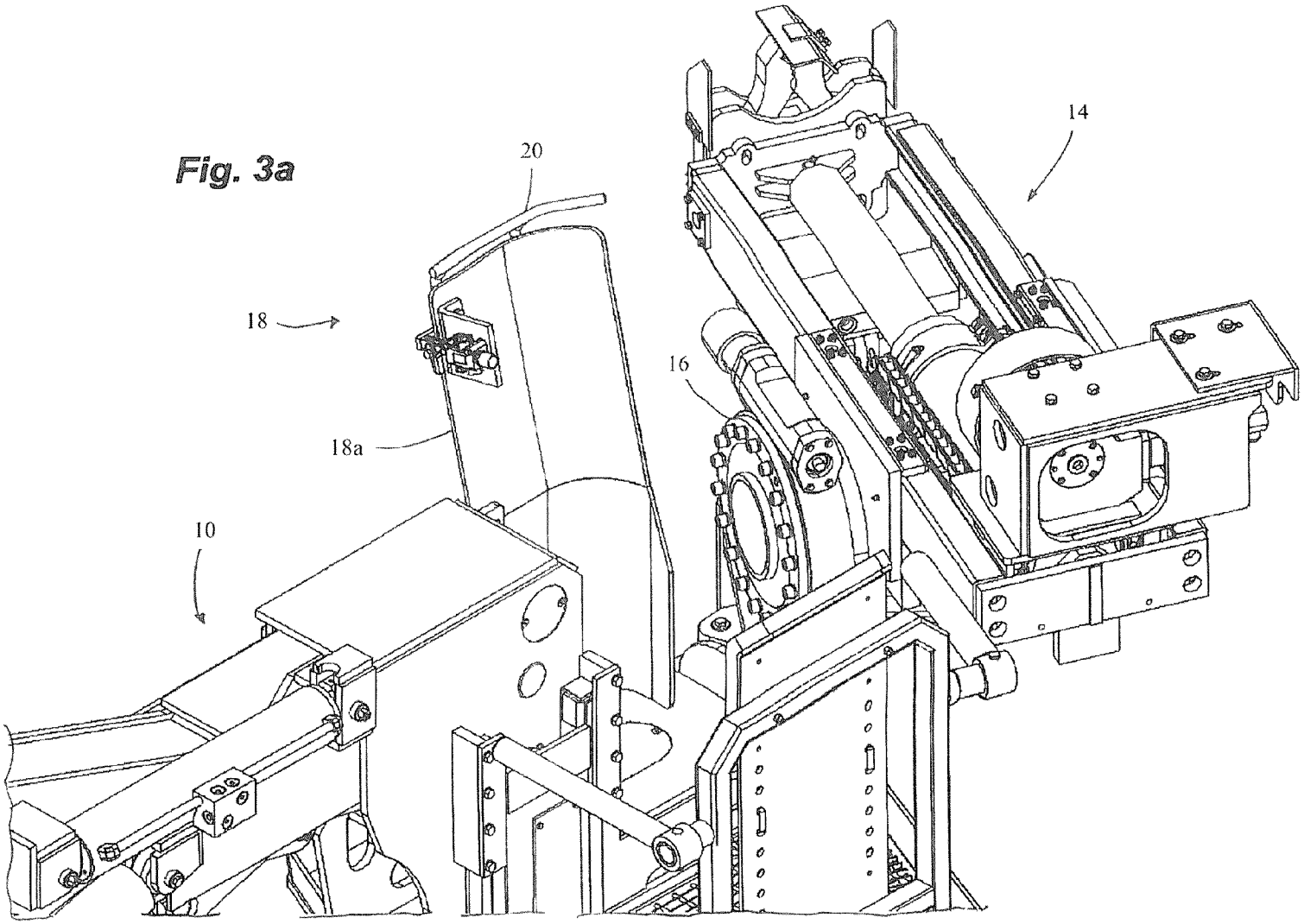
FIG. 3*a* is a partially cutaway, rear perspective view of the operator's station of the boom.
Figure 3B:
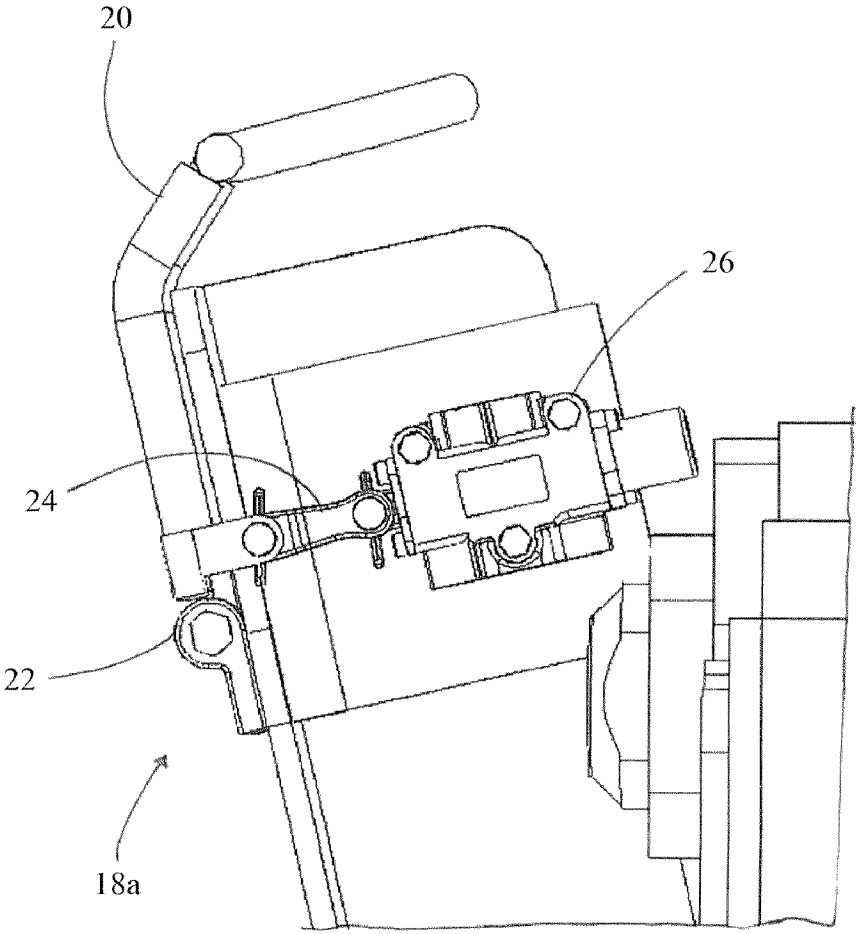
FIG. 3*b* is a cutaway side view showing a portion of the operator's station.

Turning now to FIGS. 3*a* and 3*b*, it may also be desirable to provide a guard, such as shield 18, on the side of the operator's station 12 adjacent the rib R. This shield 18 should be of a height sufficient to prevent the operator from exiting the platform 12*a* of the station 12 in the direction of the rib R, and preferably of a height sufficient to protect the operator from the rib R (including rib rolls) without hampering access. In addition, as shown in FIGS. 2*b* and 3*a*, the upper section 18*a* of this shield 18 is preferably angled outwardly in the direction of the rib R to facilitate access thereto.

A further shield in the form of a canopy (not shown) may also be provided adjacent the station 12 for shielding the operator from the roof F, as well as for possibly engaging it and providing temporary support thereto before the anchors are installed. Preferably, any corresponding support is also positioned so as to avoid interfering with the operator's access to the rib R.

Referring to FIGS. 3*a* and 3*b*, an optional but desirable feature is to strategically associate a disable switch with the boom 10. For example, a lever 20 may be capable of cutting off the power required for moving the boom 10 when pushed towards the rib R. Preferably, the lever 20 is located so it will be activated if the operator O standing adjacent shield 18 on platform 12*a* leans towards the rib R, and thus upon being activated prevent further advance of the boom 10 in this condition. Most preferably, the upper section 18*a* of the shield 18 supports the lever 20, such as by carrying a pivot mount 22 (which may be biased toward the operator O to prevent inadvertent actuation). A linkage 24 may also mechanically connect the lever 20 to a disable mechanism 26, which may comprise a valve positioned in the path of the fluid flow from the control for controlling the boom to the associated motive device(s).

FIGS. 4*a* and 4*b* show a bolting machine in the form of a mobile vehicle V (note crawler tracks K) serving as the base and incorporating a boom 10 with the improved rib reach feature. This vehicle V includes an interior walkway W defined at least partially by an elevated platform 32 to allow the operator to access the operator station 12 from inside the vehicle V, thereby avoiding the need for the operator to walk in the space between the lateral side $L_1$ and the rib R. With specific reference to FIG. 4*b*, it can be seen that the operator O simply steps from this walkway onto the associated auxiliary platform 12*b* when the boom 10 is in the home or retracted position. An optional gate 28 may also be pivotally mounted to block access to the walkway W once the operator is onboard and the boom 10 is deployed. The vehicle V shown also includes an automated temporary roof support device 30 for engaging the roof F adjacent the leading end.

The foregoing descriptions of various embodiments of the invention are provided for purposes of illustration, and are not intended to be exhaustive or limiting. Modifications or variations are also possible in light of the above teachings. For example, as indicated in FIG. 4*a*, the boom 10 of the present invention may be used in a dual boom arrangement, possibly with both booms accessible from a common walkway associated with a base B. The embodiments described above were chosen to provide the best application to thereby enable one of ordinary skill in the art to utilize the disclosed inventions in various embodiments and with various modifications as are suited to the particular use contemplated. All such modifications and variations are within the scope of the invention.

The invention claimed is:

1. An apparatus for use by an operator in forming boreholes in an underground mine passage including a rib and a roof, comprising:

a base;

an elongated boom having a longitudinal axis, said boom having a proximal end mounted to the base, a distal end opposite the proximal end, a first lateral side adjacent the rib, and a second lateral side opposite the first lateral side;

a drill supported by the boom near the distal end thereof, said drill being adapted for drilling into the rib of the mine passage; and an operator's station carried by the boom adjacent the drill, said operator's station adapted to allow the operator to access the rib when positioned on the operator's station without interference from the boom and the drill, wherein the boom includes a first portion located adjacent a first end of the operator's station, and wherein the drill is located adjacent a second end of the operator's station opposite the first end and extends generally transverse to the longitudinal axis of the boom, whereby a space is provided on the operator's station between the first portion of the boom and the drill for accommodating the operator.

2. The apparatus of claim 1, wherein the operator's station is at least partially positioned between a first plane extending generally parallel to the rib and a second plane aligned with an adjacent face of the boom.

3. The apparatus of claim 1, wherein the operator's station includes a platform for supporting the operator arranged at least partially between a generally vertical plane aligned with the second lateral side and the rib.

4. The apparatus of claim 1, wherein the operator's station further includes a shield for at least partially shielding the operator from a face of the mine passage.

5. The apparatus of claim 4, wherein the shield is adapted to prevent the operator from exiting the platform in a direction of the rib.

6. The apparatus of claim 4, wherein a disable switch is associated with the shield.

7. The apparatus of claim 6, wherein the disable switch is connected to a lever pivotally mounted to an upper portion of the shield.

8. The apparatus of claim 1, wherein the operator's station extends across a central longitudinal axis of the boom to the second lateral side of the boom.

9. The apparatus of claim 1, wherein the boom comprises a plurality of telescoping sections and means for telescoping the sections.

10. The apparatus of claim 1, further including means for raising or lowering the boom.

11. The apparatus of claim 1, further including means for moving the drill relative to the boom.

12. The apparatus of claim 1, wherein the drill is adapted to provide a generally horizontal drilling axis that intersects a plane generally parallel to a generally vertical face of the rib.

13. The apparatus of claim 1, wherein the operator's station includes a platform for supporting the operator in a standing position, and an upper surface of the boom is above the platform.

14. The apparatus of claim 13, further including a vehicle having a walkway with an exit end adjacent to the platform of the operator's station.

15. The apparatus of claim 13, further including a second boom having a second operator's station, wherein the first and second operator's stations are accessible from an interior walkway.

16. The apparatus of claim 1, further including a turret for mounting the drill to the distal end of the boom.

17. The apparatus of claim 1, wherein the drill includes a drilling axis oriented transverse to the longitudinal axis of the boom.

18. The apparatus of claim 17, further including crawler tracks for moving the base in a direction generally transverse to the drilling axis.

19. An apparatus for use by an operator in forming boreholes in a mine passage including a rib and a roof, comprising:

a base;

an elongated boom carried by the base having a longitudinal axis;

a drill supported by the boom near the distal end thereof and arranged for drilling along a drilling axis generally transverse to the longitudinal axis of the boom;

a motive device for moving the boom relative to the base;

an operator's station carried by the boom adjacent the drill, said operator's station including a platform for supporting the operator in a manner that permits the operator to access the rib, said platform including a shield for at least partially shielding the operator from the rib, and a disable switch for disabling the motive device upon the operator at the station leaning toward the rib.

20. The apparatus of claim 19, wherein the disable switch is connected to a lever pivotally mounted adjacent to an upper end of the shield.

21. The apparatus of claim 19, wherein the drill is adapted to provide a generally horizontal drilling axis.

22. A method for forming boreholes in a mine passage including an adjacent rib and a roof, comprising:

providing a vehicle including a boom having a longitudinal axis and carrying a drill oriented for drilling generally transverse to the longitudinal axis, said boom including a station adapted for receiving an operator in a space at least partially between the rib being drilled and a plane aligned with an adjacent lateral face of the boom facing the rib; and drilling a borehole in the rib using the drill.

23. The method of claim 22, wherein the boom is enabled to move, and further including the step of disabling the boom in response to the operator leaning towards the rib.

24. The method of claim 22, wherein the drilling step comprises drilling along an axis transverse to a direction of travel of the vehicle, and further including the step of installing an anchor in the borehole.

25. The method of claim 22, wherein the boom is enabled to move, and further including the step of disabling the boom in response to the operator moving a shield for shielding the operator from the rib.

26. An apparatus for use by an operator in forming boreholes in an underground mine passage including a rib and a roof, comprising:

a base;

an elongated boom having a longitudinal axis, said boom having a proximal end mounted to the base, a distal end opposite the proximal end, a first lateral side adjacent the rib, and a second lateral side opposite the first lateral side;

means for drilling in a direction transverse to the longitudinal axis of the boom; and an operator's station carried by the boom for receiving the operator in a position between the distal end of the boom and a proximal end of the means for drilling.

27. The apparatus of claim 26, wherein the means for drilling comprises a drill having a drilling axis oriented transverse to the longitudinal axis of the boom.

28. The apparatus of claim 27, further including crawler tracks for moving the base in a direction generally transverse to the drilling axis.

29. An apparatus for use by an operator in forming boreholes in an underground mine passage including a rib extending in a vertical direction to a roof, comprising:

a base;

an elongated boom having a longitudinal axis, said boom having a proximal end mounted to the base, a distal end opposite the proximal end, a first lateral side adjacent the rib, and a second lateral side opposite the first lateral side;

a drill supported by the boom near the distal end thereof, said drill being adapted for orientation in the vertical direction and also in a transverse direction relative to the longitudinal axis of the boom and the vertical direction in order to form the borehole in the rib of the mine passage; and an operator's station carried by the boom adjacent the drill, said operator's station adapted to allow the operator to access the rib when positioned on the operator's station without interference from the boom or the drill.

30. The apparatus of claim 29, wherein the operator's station further includes a shield for at least partially shielding the operator from a face of the mine passage.

31. The apparatus of claim 30, wherein a disable switch is associated with a pivotally mounted lever adjacent to the shield for disabling a motive device connected to the boom.

* * * * *